US006749017B1

(12) United States Patent
Lu et al.

(10) Patent No.: US 6,749,017 B1
(45) Date of Patent: Jun. 15, 2004

(54) FULL AUTOMATIC MACHINE FOR OIL EXTRACTION

(76) Inventors: Xu Lu, A203 Beijing Dart Business Garden No. 10A Huixinli, Anwai, Xiaoguan, Chaoyang Dist., Beijing (CN), 100029; Ying Li, A203 Beijing Dart Business Garden No. 10A Huixinli, Anwai, Xiaoguan, Chaoyang Dist., Beijing (CN), 100029

( * ) Notice: Subject to any disclaimer, the term of this patent is extended or adjusted under 35 U.S.C. 154(b) by 0 days.

(21) Appl. No.: 10/069,712

(22) PCT Filed: Aug. 25, 2000

(86) PCT No.: PCT/CN00/00249

§ 371 (c)(1),
(2), (4) Date: Jun. 11, 2002

(87) PCT Pub. No.: WO01/16487

PCT Pub. Date: Mar. 8, 2001

(30) Foreign Application Priority Data

Aug. 27, 1999 (CN) ..... 99119243 A

(51) Int. Cl.[7] ..... E21B 43/00
(52) U.S. Cl. ..... 166/53; 166/68.5; 166/105
(58) Field of Search ..... 166/250.15, 67, 166/68.5, 72, 73, 105, 53

(56) References Cited

U.S. PATENT DOCUMENTS 4,460,038 A 7/1984 Clamens
4,651,582 A 3/1987 Bender
4,665,761 A 5/1987 Bao
4,693,171 A * 9/1987 Dollison ..... 91/126 B
5,027,666 A * 7/1991 Filicetti ..... 73/37
5,375,657 A 12/1994 Shi et al.
5,432,709 A 7/1995 Vollweiler et al.
6,041,856 A * 3/2000 Thrasher et al. ..... 166/53

FOREIGN PATENT DOCUMENTS

CN 87 2 16773 U 9/1988
CN 87 1 03481 A 11/1988
CN 2068607 U 1/1991
CN 2112684 U 8/1992
CN 1080693 A 1/1994

OTHER PUBLICATIONS

English translation of the abstracts of the reference cited in the International Search Report IEE000015PUS, undated, pp. 1–3.

* cited by examiner

*Primary Examiner*—William Neuder
(74) *Attorney, Agent, or Firm*—Senniger, Powers, Leavitt & Roedel

(57) ABSTRACT

This device is related to the domain of fully automatic machines for oil extraction. An axle transmission and soft belt suspension system is used in the device. A decelerator connects an electric motor and a driving hub, so that the transmission belt can be driven. When the driven hub and the bridle are connected, the sucker rod will be connected so that the oil-well pump can start working. There are several other units, an absolute value coder that can measure the driven hub's angle of rotation, a augmenter coder that can measure the rotational speed of the electric motor and an oil gauge. In the device, a oil production process controller processes collects signals and then the device controls the machine, the beam and the pump system automatically. It has the advantages of saving energy, high efficiency for oil extraction and long operational life span.

3 Claims, 12 Drawing Sheets

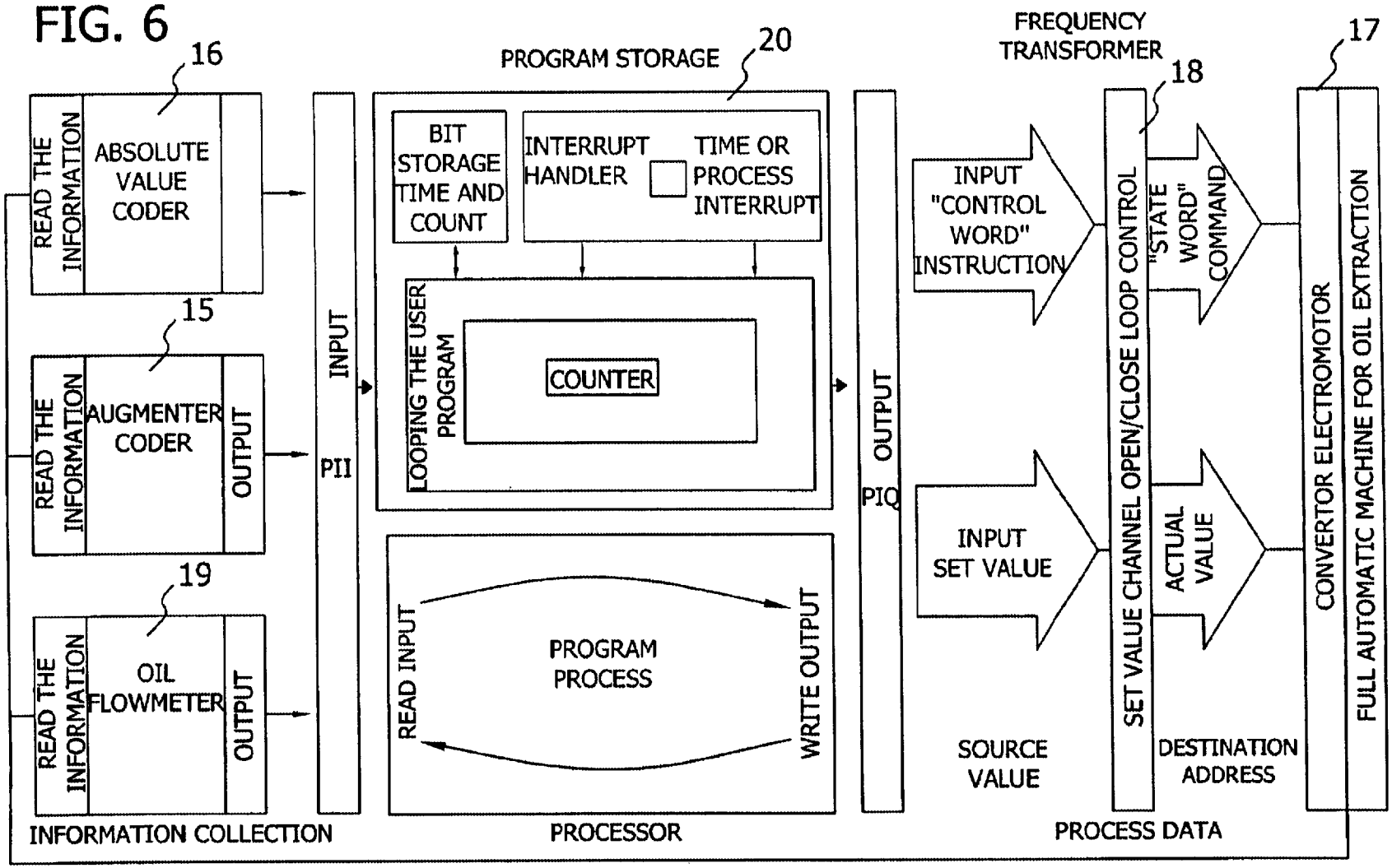
FIG. 6
16
ABSOLUTE VALUE CODER
READ THE INFORMATION
15
AUGMENTER CODER
OUTPUT
READ THE INFORMATION
19
OIL FLOWMETER
OUTPUT
READ THE INFORMATION
INFORMATION COLLECTION
INPUT
PII
PROGRAM STORAGE
20
BIT STORAGE TIME AND COUNT
INTERRUPT HANDLER
TIME OR PROCESS INTERRUPT
LOOPING THE USER PROGRAM
COUNTER
READ INPUT
PROGRAM PROCESS
WRITE OUTPUT
PROCESSOR
OUTPUT
PIO
INPUT "CONTROL WORD" INSTRUCTION
INPUT SET VALUE
SOURCE VALUE
PROCESS DATA
FREQUENCY TRANSFORMER
18
SET VALUE CHANNEL OPEN/CLOSE LOOP CONTROL
"STATE WORD" COMMAND
ACTUAL VALUE
DESTINATION ADDRESS
17
CONVERTOR ELECTROMOTOR
FULL AUTOMATIC MACHINE FOR OIL EXTRACTION

FULL AUTOMATIC MACHINE FOR OIL EXTRACTION

BACKGROUND OF THE INVENTION

The present invention relates to a device for oil extraction. It is a fully automatic machine for oil extraction that is digitally controlled by computers.

In the oil industry, there is a problem with how to make the machines' adapt to the change of oil saturation which is the main factor that affects the oil production. If the problem is successfully solved, production will increase. Otherwise it will decrease. Presently, there are nearly 20 oilfields and nearly 100,000 mechanical machines working for oil extraction in the country. Several kinds of energy saving machines have been utilized, but they are still driven by an electrical machine. A speed change of a decelerator drives a beam-pumping unit and a sucker rod pump underground to extract oil. The machines drop behind in technique because of their physical constructions. They consume a great deal of energy. Their efficiency is low and their mechanical loss is very large. As a whole, there are three main problems affecting the traditional machines. First, the beam-pumping unit works in a way to change its motion from a circular motion to a rectilinear motion. When this works, there is a great unbalanced force. Take the size 12 machine as an example. The unbalanced force is 5 tons. A mechanical machine works 6 times per minute and more than 4300 times per 24 hours. During the 24 hour period, a lot of energy is wasted. With the energy, a 5-ton crane can lift 5-ton of goods over 4300 times. Secondly, different oiliness underground causes the changes of the oil gas saturation and the depth of the reservoir. The mechanical machine's can not adapt to the changes, so the efficiency is only about 20%. Thirdly, the operation of the mechanical machine is not logical in technique, so the real work is only about 30% and the damaging rates of the machines are very high.

SUMMARY OF THE INVENTION

This device is invented with the purpose of supplying a fully automatic machine for oil extraction. This is accomplished by the fully automatic control by computers and with a new running mode and a more logical mechanism. The device achieves the goal of reducing the waste of energy and increasing the efficiency of oil extraction.

The fully automatic machine mentioned in the present invention for oil extraction adopts the structure of an axle transmission and a soft belt suspension. An electric motor 17 connects a decelerator 5 with an axle and the decelerator 5 connects a driven hub 7A with an axle in order to drive a transmission belt 10A and 10B. When a driven hub 7B connects the bridle 9, the sucker rod 8 will be connected and then the oil well pump 24 can be driven to work. When the electrical machine rotates in a forward direction, the oil is extracted. When the electrical machine rotates in a reverse direction, it is a return trip. When the driving hub 7A drives the transmission belt 10A and 10B, it also drives the transmission belt 11. The other end of the transmission belt 11 connects the balancer balance weight 12 that works synchronously with the pump 24 in a forward or reverse direction. This fully automatic machine invented for oil extraction consists of a base 1, a bracket 2 and a platform 3. The electric motor 17, the decelerator 5, the driving hub 7A and the driven hub 7B are all fixed on the platform 3. The electric motor 17 and the oil production process controller 20 are connected by the driven masterdrive frequency transformer 18. The electric motor 17 receives the control instructions sent by the programmable controller 20 with the masterdrive frequency transformer 18 that works as a host drive. The oil production process controller 20 receives input from an absolute value coder 16 that provides information on the running state. The oil production process controller 20 collects the information about the position and angle of rotation of the driving hub output axle. The travel detecting and brake part consists of the absolute value coder 16 and a break unit.

In the invention, a central processing unit, an input/output module and a liquid crystal display constitute the oil production process controller 20.

In this fully automatic machine for oil extraction, the oil production process controller 20 and the augmenter coder 15 are connected, and the oil production process controller 20 is also connected with the oil flowmeter 19. In this way, the oil production process controller 20 collects the information about the rotational speed of the converter electrical machine and the oil production of the producing tube respectively. The augmenter coder 15 gets the information about the position, the angle and the rotational speed of the axle of the electric motor 17 directly by measuring. After the programmed control of the oil production process controller 20, the control instructions will be generated. The control instructions can control the commutation of the electric motor 17 and set and adjust its rotational speed.

This fully automatic machine for oil extraction works by balancing the hanger load with gravity directly and by the accurate calculation of the computers. When this machine works, the efficiency can reach over 90%, and over 50% of the electric energy can be saved. This machine uses the combination of a digital vector frequency converter, a augmenter coder and a converter electrical machine as the drive, so that it can complete the soft drive. During the course of running, the machine can adjust its stroke and frequency to make them fit 100 percent to the change of the oiliness, the oil current and the oil-bearing stratum. It can accurately adjust the running speed of the ascending travel or the downgoing travel to fit to the rise of the hanger of the oil-well so that the efficiency of oil extraction will increase. The computer controls the machine, so in the condition of parameter optimization, all the systems in the machine can work continuously and firmly for a long period of time. Under the control of the computer, the operational life span of the machine is effectively extended, the rate of the loss caused by the breakdown of the parts decreases, and the cost of this device is cut down. This invention has the advantages of a large load capacity, manual, automatic, or long-range communication administration, self-diagnosis for breakdown, automatic alarm and so on.

This machine is applicable in deep oil-wells, oil-wells with high moisture content, inspissated oil wells and common oil-wells.

BRIEF DESCRIPTION OF THE DRAWINGS

FIG. 6: Is a block diagram of the principle of the automatic control of this fully automatic machine invented for oil extraction;

DETAILED DESCRIPTION OF THE PREFERRED EMBODIMENT

Figure 1:
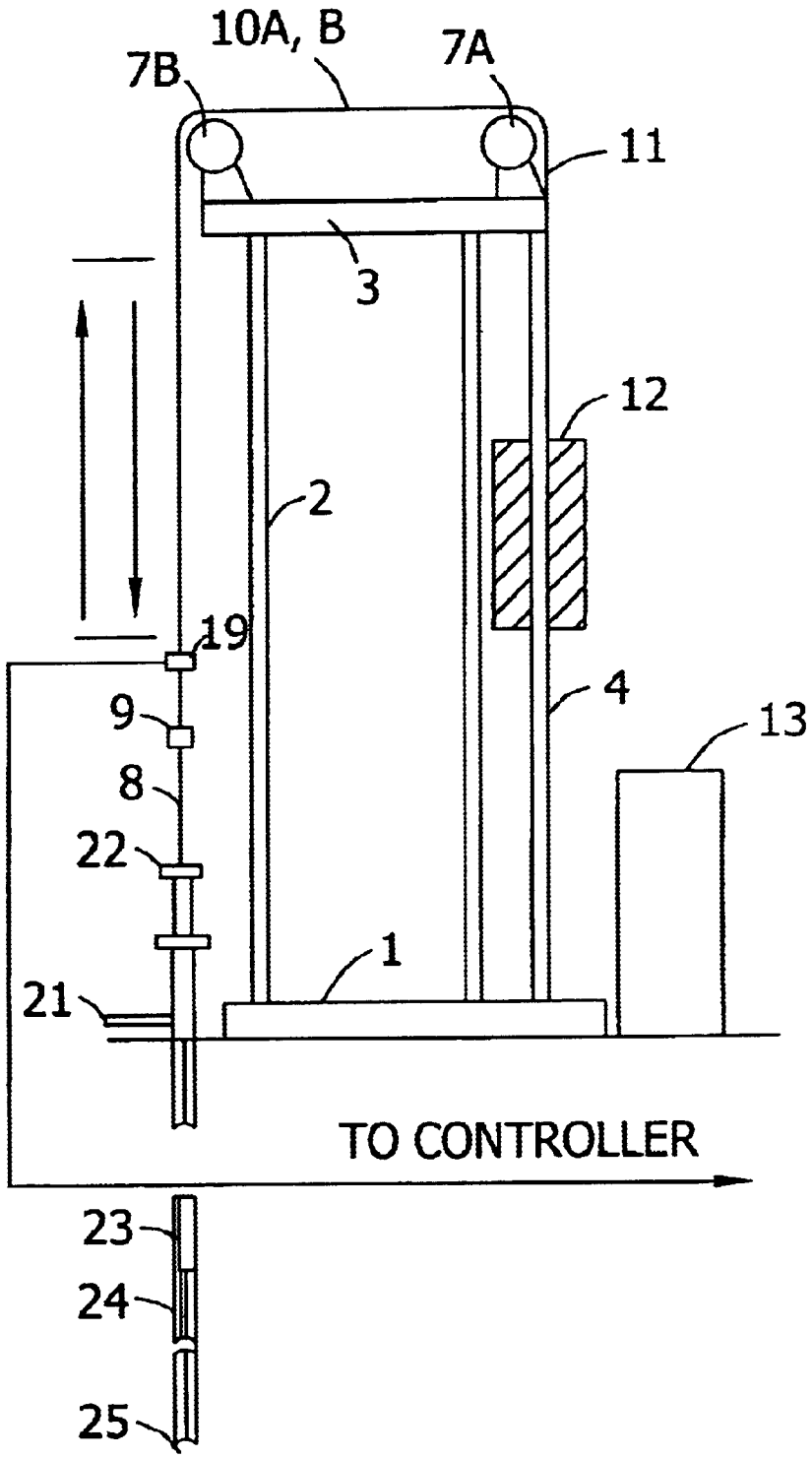
FIG. 1: Is a front view of the structure of a first preferred embodiment of this fully automatic machine invented for oil extraction.
Figure 2:
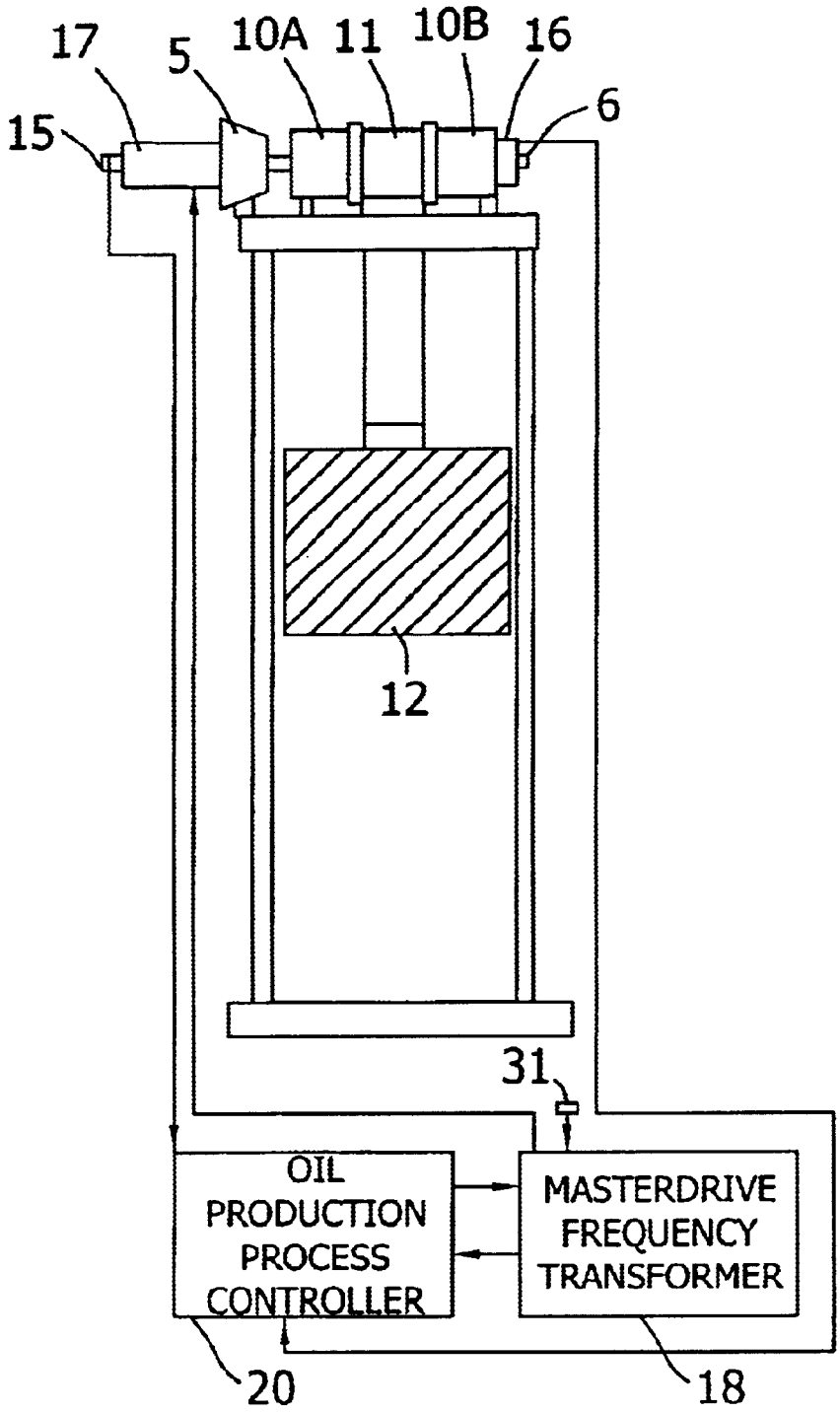
FIG. 2: Is a right side view of the structure of FIG. 1 of this fully automatic machine invented for oil extraction.
Figure 3:
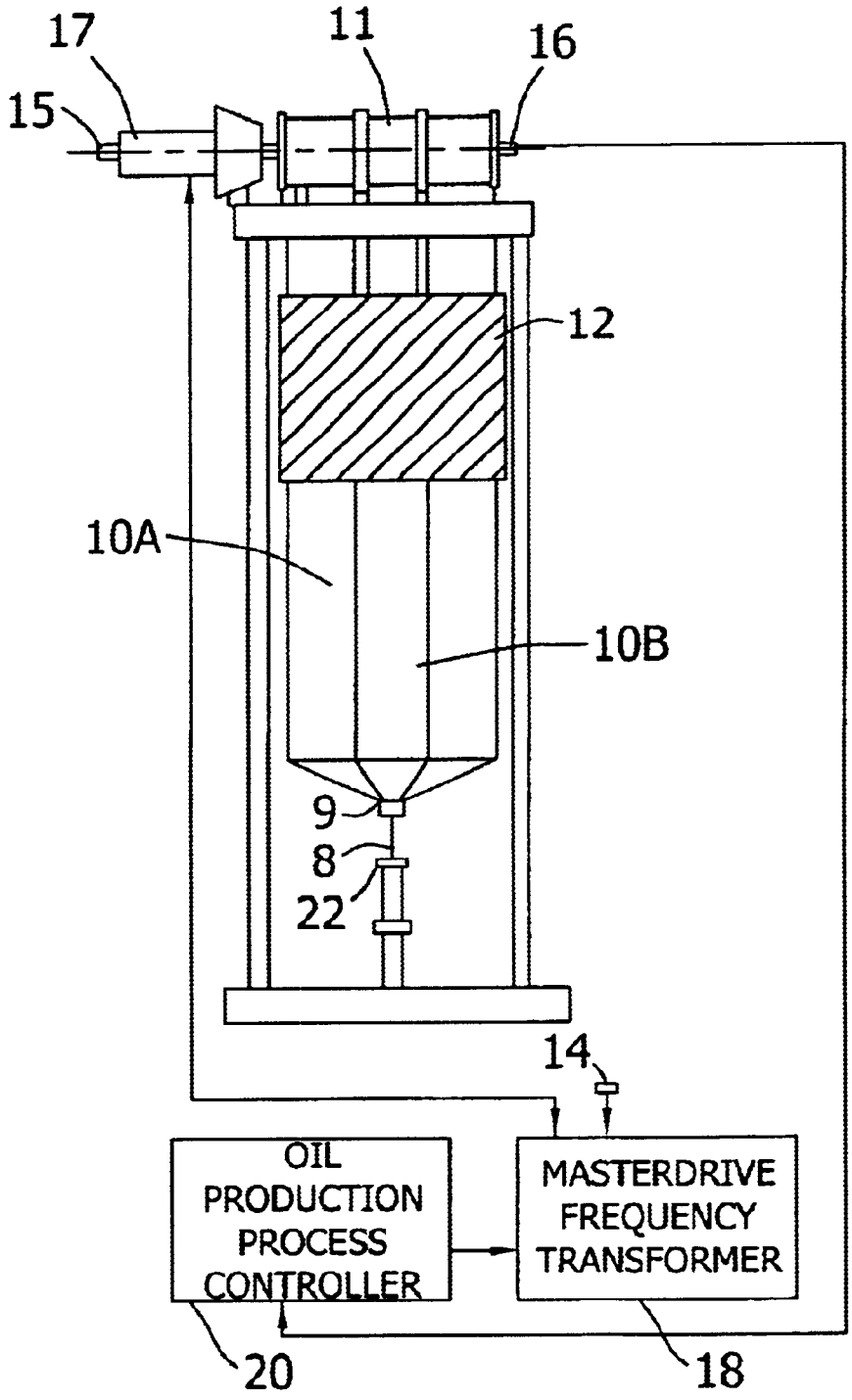
FIG. 3: Is a right side view of the balancing relation between the load and the balancer of the embodiment of FIG. 1 of this fully automatic machine invented for oil extraction.
Figure 4:
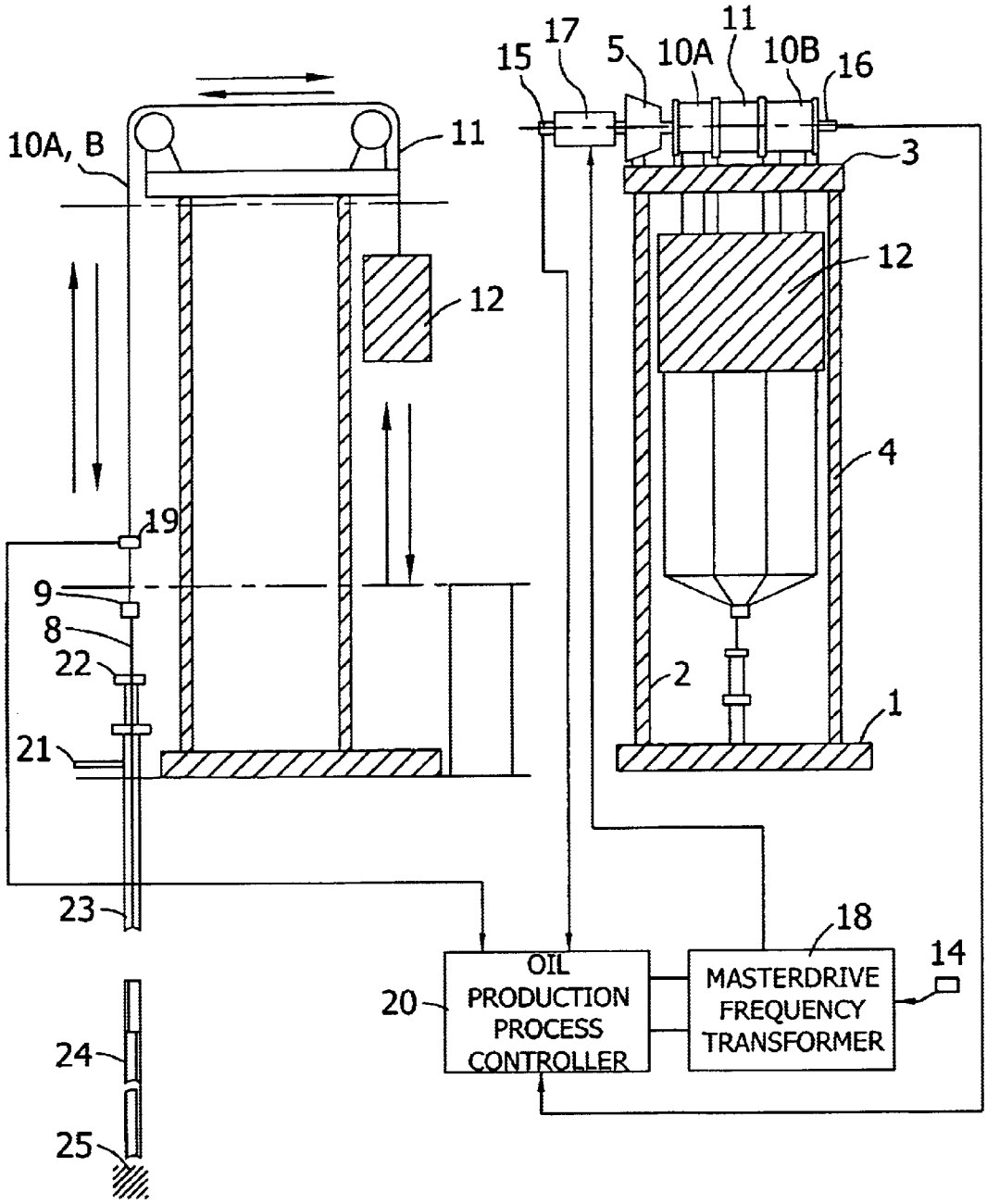
FIG. 4: Is a schematic view showing the relationship of the starting, stroke, oil pumping strokes and the running of the return trip pump load of this fully automatic machine invented for oil extraction.

A first preferred embodiment is illustrated in FIG. 1, FIG. 2, FIG. 3 and FIG. 4. The operational principle of this machine is that power source 14 and the frequency transformer 18 are connected by the electrical circuits and then the electric motor 17 is also connected. When the power is switched on, the electric motor 17 can rotate in forward or reverse direction, and an axle connects it and the decelerator 5. The axle connects the decelerator 5 and the driving hub 7A, so that the transmission belts 10A and 10B can be driven. When the driven hub 7B connects the decelerator 5 and the bridle 9 and the sucker rod 8 will be switched on and the oil well pump 24 will be driven. When the electrical machine rotates in a forward direction, the oil will be extracted. When it rotates in a reverse direction, that is a return trip. When the electrical machine rotates in a forward direction, the distance of travel is called a stroke. A cycle of rotation in both a forward and a reverse direction is called an oil pumping stroke. If a cycle is achieved, the machine extracts the oil once.

When driving hub 7A drives the transmission belts 10A and 10B, it also drives the transmission belt 11. The balance 12 is connected to the other end of the transmission belt 11. When the oil well pump driven by the electrical machine works in either a forward or a reverse direction, in order to keep the balance, the balancer 12 will work synchronously as the pump. Moreover, chains or cables may take the place of the transmission belts 10A and 10B.

The oil production process controller 20 receives the information about the accurate angle and position of rotation of the driving hub's output axle with the absolute value coder 16. The coder 16 transmits the position signals to the oil production process controller 20 through electric circuits. The oil production process controller 20 transmits the software instructions to the frequency transformer 18 with the computer programs. The frequency converter 18 then can drive the electric motor 17, and this machine can achieve the functions of the stroke arresting and adjusting.

In this machine, there are also some other units, a base 1, a bracket 2, a platform 3, a slideway 4 of the balancer, a distribution box 13, an oil flowmeter 19 and a producing pipeline 21. In the drawings, number 22 stands for the mouth of the well, and number 23 stands for the oil in the oil pipe underground.

The transmission belts 10A and 10B, the bridle 9, the sucker rod 8, the oil well pump 24, the oil 23 in the oil pipe (when the oil in the oil pipe is extracted, the friction force constitutes the total load of the machine), the counterpoised belt 11 and the balancer 12 contribute the counterweight system of this machine.

The decelerator 5 rotates with variable speeds in order that the electric motor 17 can drive the load belts 10A and 10B, the bridle 9, the sucker rods, the oil well pump 24 and the oil 23 in the oil pipe to move upward to extract the oil. At the same time, there is the work of the electric motor 17. In order to decrease the power of the electric motor 17 and reduce the energy consumption, the electric motor 17 is connected to the decelerator 5 and is connected with the belts 10A and 10B by the driving hub 7A. When operating in the reverse direction the electrical machine connects the counterpoised belt and the balancer 12 and when the machine works, the equilibrium relation of hanger load and balance weight is formed. In this way, the aim of decreasing the running power of the electrical machine and saving the electrical energy is achieved.

The electrical circuits connect the frequency transformer 18 and the electric motor 17, and the frequency converter 18 can collect the information about the frequency and the current changing signals of the electrical machine when it is running under load. This information is transmitted to the oil production process controller to be processed. By calculating, the oil production process controller can get the loading data for different positions when the machine is running. According to this data, reverse calculations can be made to get the counterweight data that are needed. When the machine is in load running, by changing the counterweight manually, the efficiency can reach 85% to 100%, and over 80% of the energy can be saved. That is to say, in all the machines for oil extraction, this fully automatic machine invented can extract the oil with low energy consumption that has reached the minimum margin.

The controller coder 15 collects the signals of the rotational position and speed of the axle 8 in the electric motor 17.

The oil production process controller 20 collects the signals of the rotational speed, the frequency and the current of the electrical machine in the frequency converter 18.

The oil production process controller 20 collects the oil producing signals of this machine from the oil flowmeter 19.

In the oil production process controller, after information spanning, information storing and information processing, the collected signals mentioned above can be transformed into new programmed instructions for the running of the machine.

Functions

1. The accurate mensuration of the load and the mensuration and adjustment of the counterweight of the machine;
2. The mensuration of the parameter of the starting speed of the machine with load;
3. The mensuration of the parameter of the stroke of the machine running with load;
4. The mensuration of the parameter of the oil pumping strokes of the machine running with load;

5. The mensuration of the parameter of the return trip of the machine running with load;
6. The mensuration of the parameter of the pump load of the machine running with load;

The new instructions will be transmitted to the frequency transformer 18 to drive the electric motor 17 to rotate, so that the machine can achieve the function for oil extraction.

The principle of the electric circuits:

1. The function of the absolute value coder 16 is to detect the travel of the machine. The absolute value coder 16 can directly get the positions and angles by detecting the encoding strip of the machine's driving axle and transform them into code signals. After the oil production process controller 20 processes the code signals, the "control" instructions are generated and sent to the frequency transformer 18. According to the instruction input by the oil production process controller, the frequency transformer drives the electric motor 17 to rotate, so that the machine can start running. In addition, the position detecting for the bridle 9 of the machine and the demand of accurate arresting for running can both be achieved.
2. The function of the augmenter coder 15 is to detect the rotational speed and power of the electric motor 17. The vector coder 15 can directly measure the rotational speed from the axle of the electric motor 17 and transform it into code signals. After the oil production process controller 20 processes the code signals, the "control" instructions are generated and sent to the frequency transformer 18. According to the instructions input by the oil production process controller, the frequency transformer drives the electric motor 17 to rotate, so that the machine can start running. In this way, when the electric motor rotates smoothly in a forward or a reverse direction, the load of the bridle 9 can conveniently, be balanced and accurately reverse the electric motor 17, set and adjust the rotational speed.
3. The function of the oil flowmeter 19 is to measure the production of the oil extracted through the travel of each oil pumping stroke. The oil flowmeter can measure the production of the oil from the producing tube in the mouth of the oil-well, and transform the information into data signals. After the oil production process controller 20 processes the data signals, the control instructions are generated and sent to the frequency transformer 18. According to the instructions input by the oil production process controller, the frequency transformer drives the electric motor 17 to rotate, so that the machine can start running. The stroke, the oil pumping strokes and the rotational speed can achieve the demand of the maximum oil production.
4. Since the oil production process controller 20 consists of the central processing unit, the input/output module and the liquid crystal display, it has the original advantages of high speed, large storage, many points for input and output and some stylized functions in the respect of connection and communication with the frequency converter. There are several main principles of operation. First, there is a program storage in which the user programs are stored. Second, there is a processor that can do seasonal program scanning. When the scanning cycle starts, the processor will read all the states of the signals from the input end and store them in the procedure image region for input. Under the control of the internally counting device, the bit storage and the timer, the processor scans the program step by step. The processor stores the new states of the signals in the procedure image region for output. At the end of the cycle, the new states of the information can be sent to the output end.

The absolute value coder 16, the augmenter coder 15 and the oil flowmeter 19 constitute the sensor device for the running state of the machine. The sensor device inputs the perceptive information to the program storage of the oil production process controller. After the scanner program of the processor processes the information, the sensor device will send the new states of the signals to the frequency transformer to drive the electric motor, so that the machine can start running. The oil production process controller can achieve many precise tasks. It can control the running of the machine, and show and monitor the running state of the machine. The programmable controller can amend the parameters of running, balancing, starting (load), stroke, oil pumping strokes, return trip and pump load, it also has the function of the password protection.

The frequency transformer 18 is the masterdrive device of the machine. It can accurately achieve the reversing and smooth rotation in the forward or the reverse direction of the electric motor 17 to fit to the demand of the stroke (rotation in a forward direction) and the return trip(rotation in a reverse direction) of the electric motor 17. At the same time, the frequency converter can change the frequency rapidly to make the electrical machine accurately change its rotational speed including the ultra-low speed and the ultra-high speed. It also has some other functions. For example, its essential parameter can be set and its working condition can be monitored. The frequency converter can fit to the change of the rise of the bridle in the oil-well and meet the technical demand of oil extraction. In this way, according to the different conditions of the oil-wells, the oil extraction can be carried out economically with high efficiency.

The frequency transformer receives the "control" instructions from the oil production process controller 20 and according to the instructions, it drives the electric motor 17 to make the machine for oil extraction start working.

Figure 5:
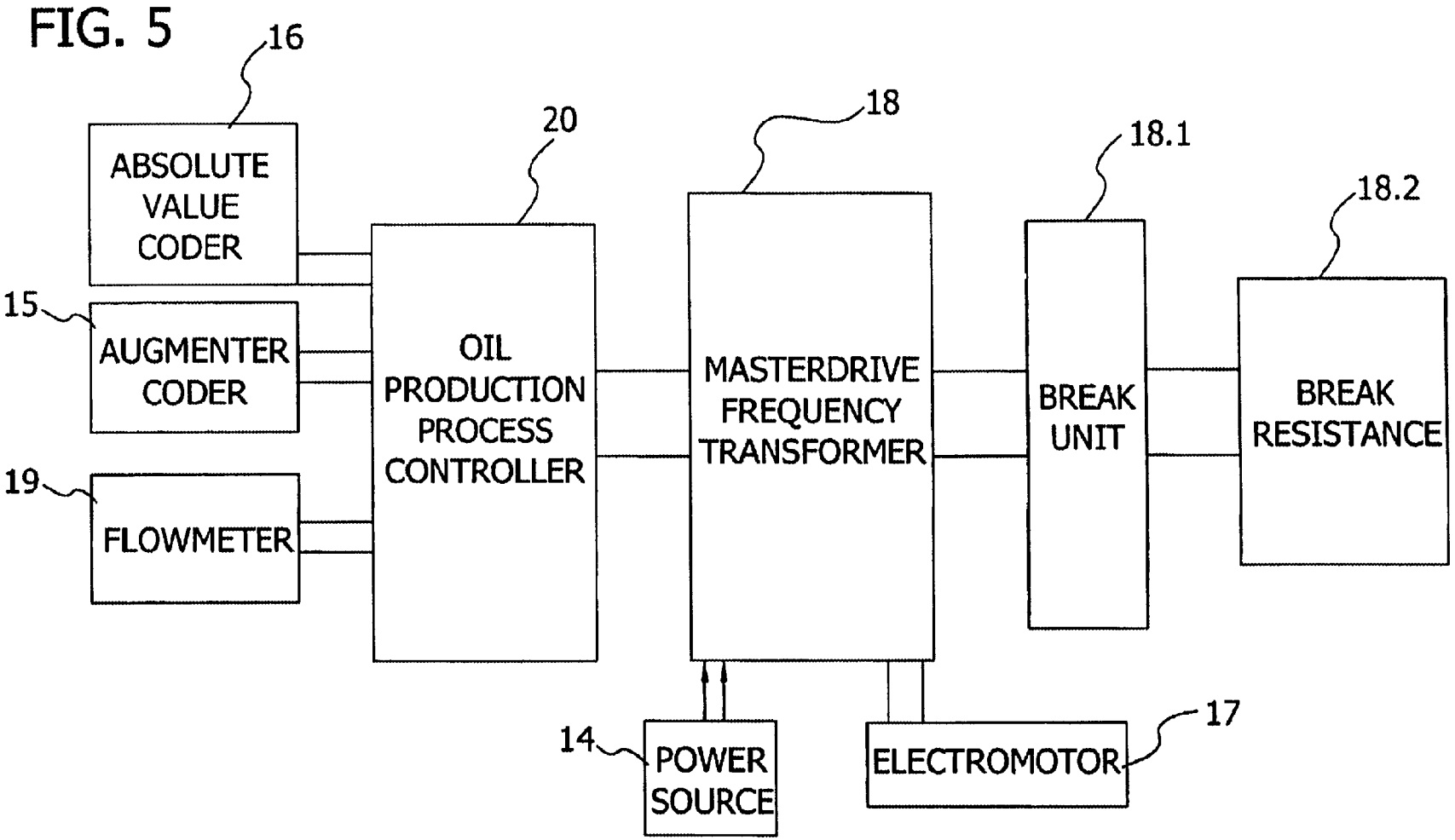
FIG. 5: Is a block diagram of the control electric circuits of this fully automatic machine invented for oil extraction.
Figure 7:
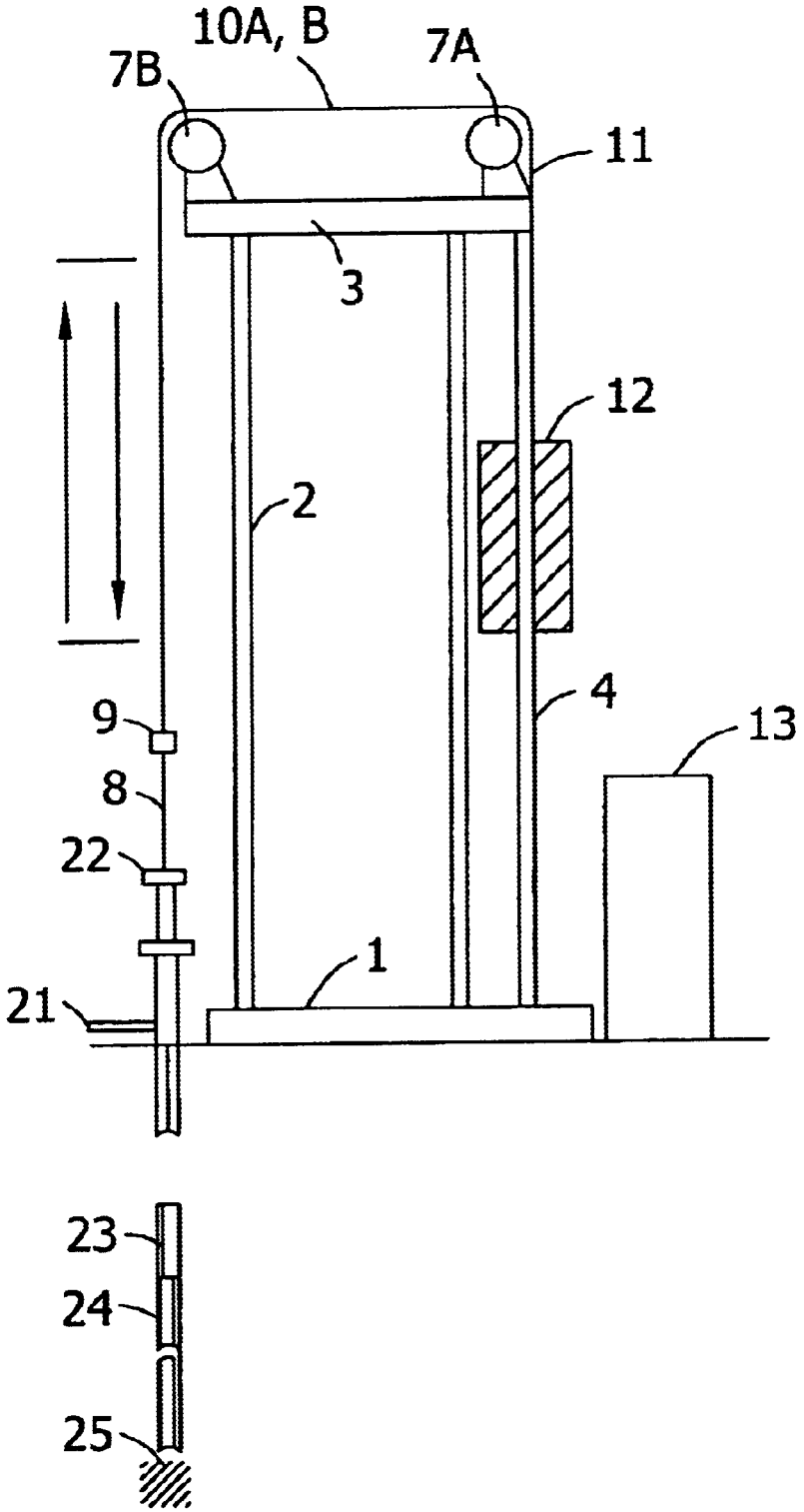
FIG. 7: Is a front view of the structure of a second embodiment of this fully automatic machine invented for oil extraction.
Figure 8:
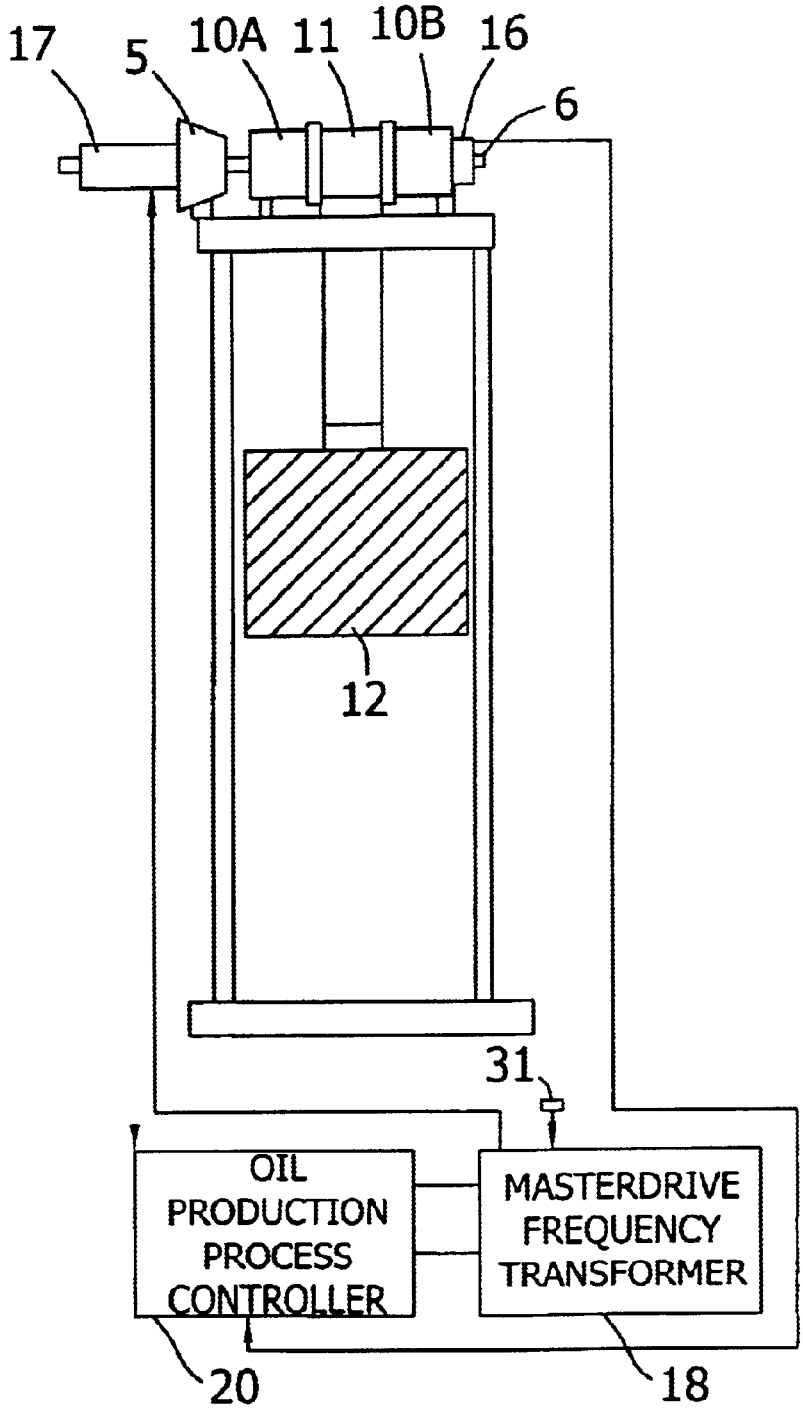
FIG. 8: Is a right side view of the embodiment of FIG. 7 of this fully automatic machine invented for oil extraction.
Figure 9:
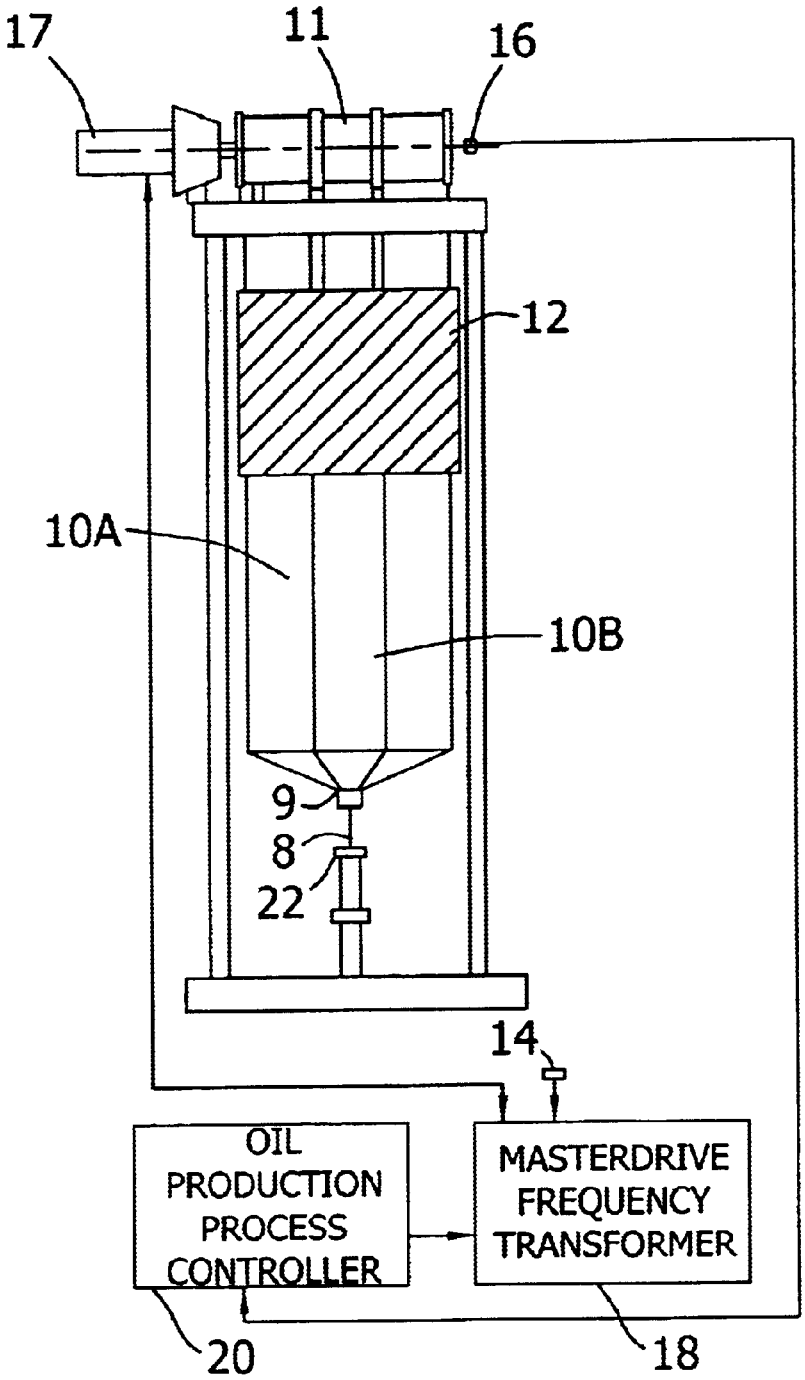
FIG. 9: Is a view of the balancing relation between the load and the balancer of the second embodiment of this fully automatic machine invented for oil extraction.
Figure 10:
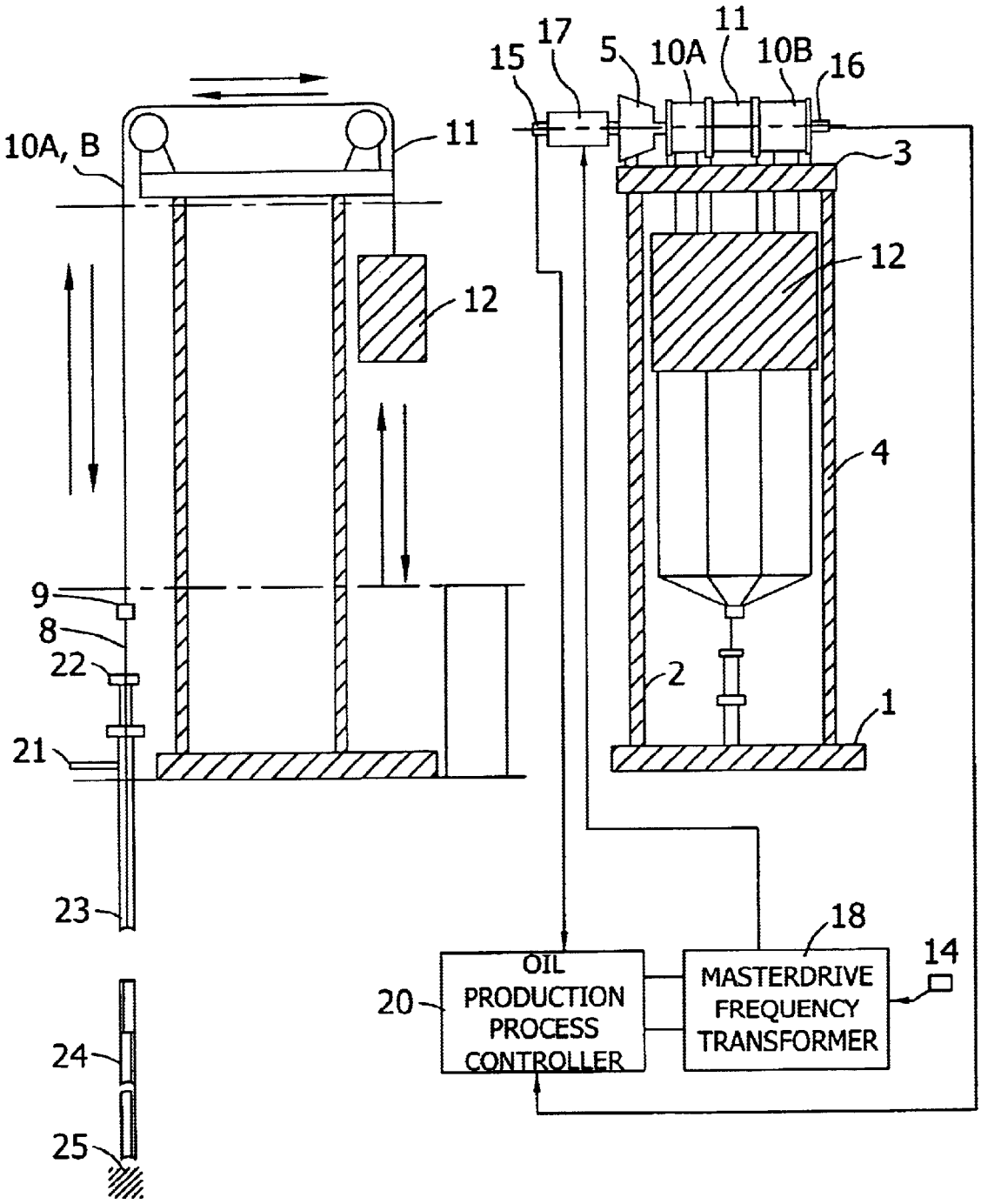
FIG. 10: Is a schematic view of the second embodiment showing the chart of the relation of the starting, stroke, oil pumping strokes, and the running of the return trip pump of this fully automatic machine invented for oil extraction.
Figure 11:
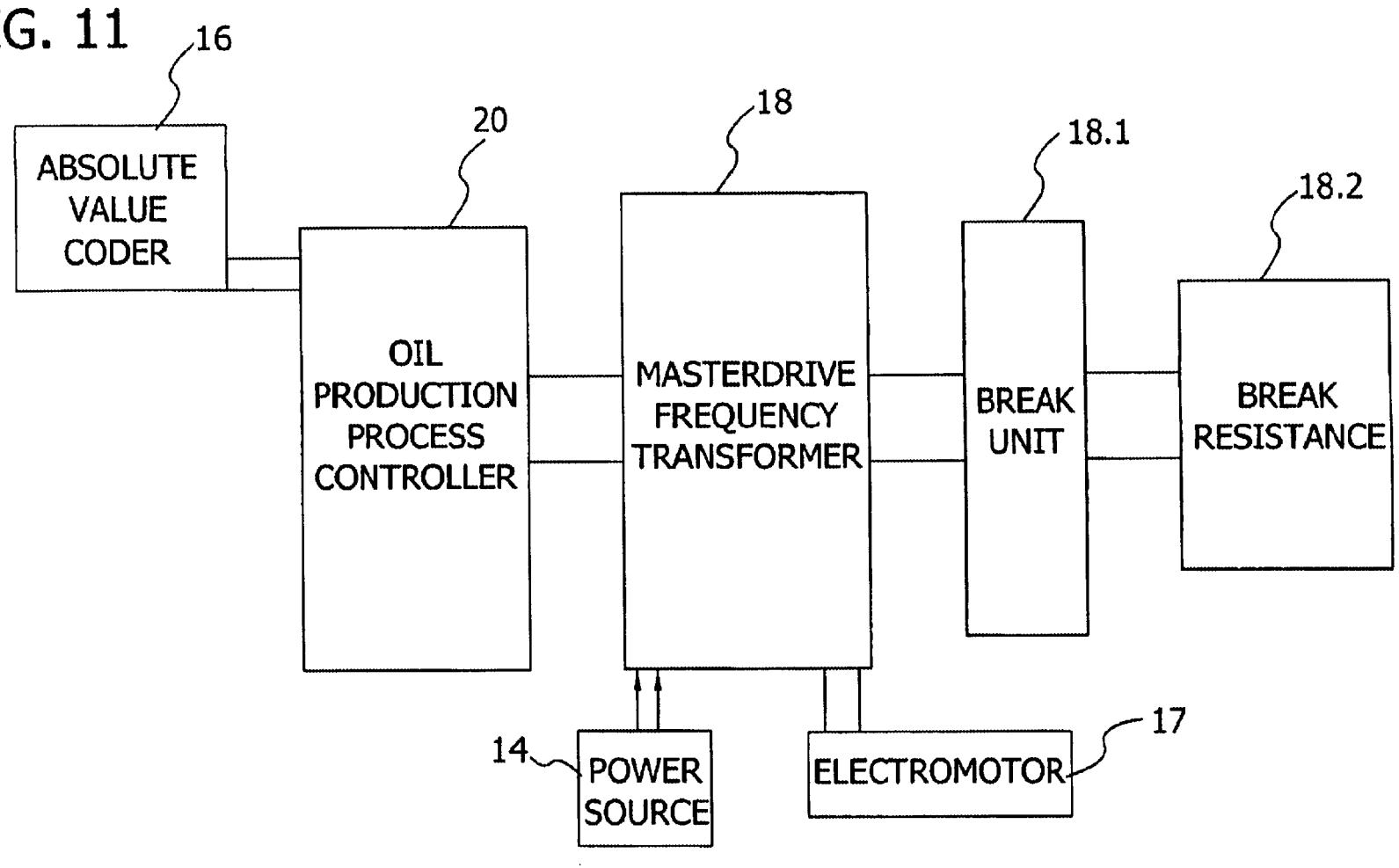
FIG. 11: Is the block diagram of the control electric circuits of the second embodiment of this fully automatic machine invented for oil extraction.
Figure 12:
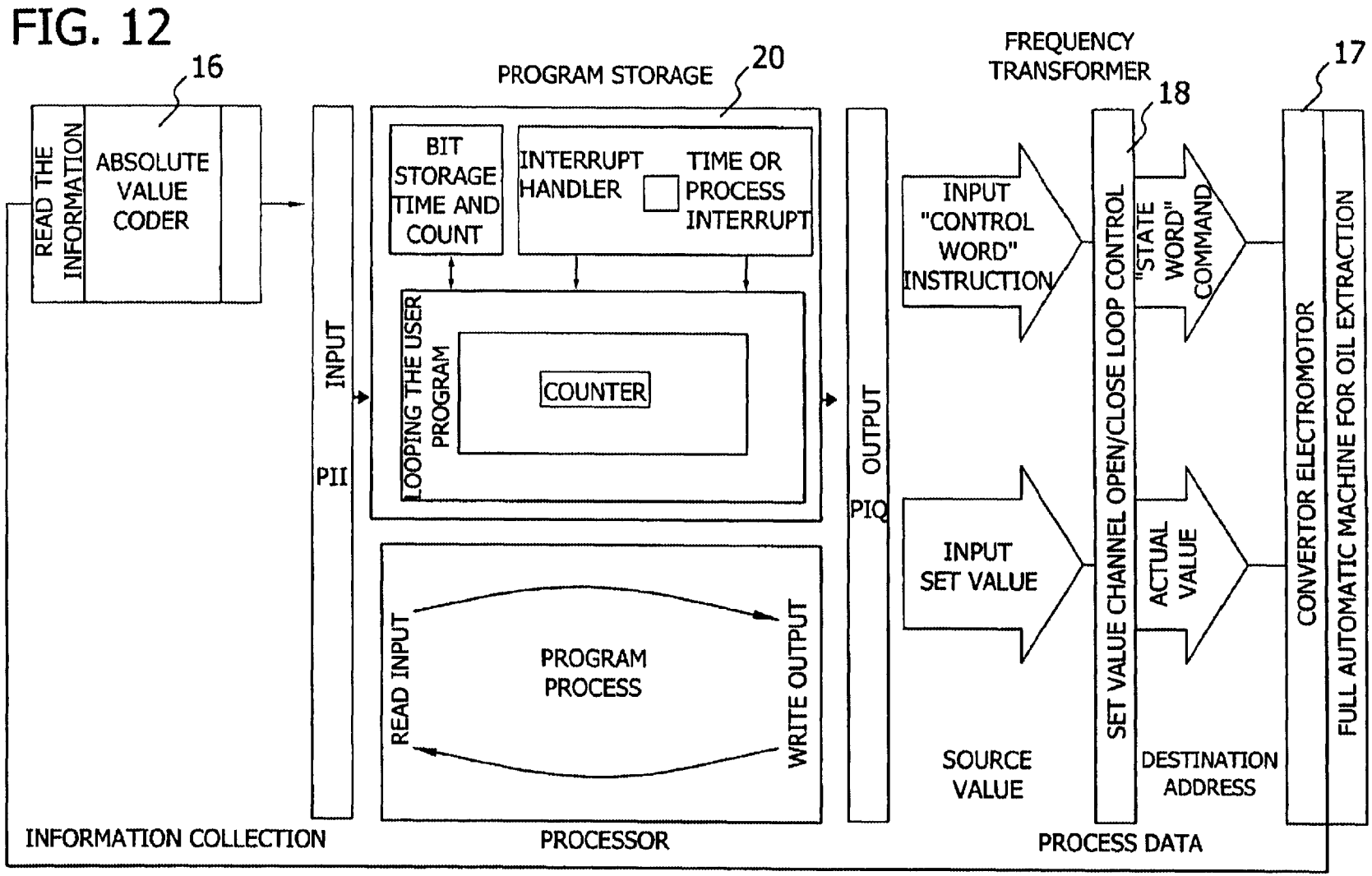
FIG. 12: Is the block diagram of the principle of the automatic control of the second embodiment of this fully automatic machine invented for oil extraction.

The process of the working electric circuits in the machine (referring to FIG. 5):

1. Set the rotational speed, the current, the rotational speed kick off power and the parameters of starting, up-stroke, oil pumping strokes and return trip to make the machine start working.
2. During the course of working, the absolute value coder 16, the augmenter coder 15, the oil flowmeter 19, the frequency transformer 18 and the electric motor 17 get the perceptions from the states of all the signals of the machine, and then send them to the oil production process controller 20. According to the specific running demands of the machine and the work conditions of the oil-wells, the programmable controller can get the parameters for machine running with which the producing rate of the machine will be optimal. Then the new states of the signals will be sent to the frequency transformer 18 to drive the electric motor 17.
3. The machine works automatically according to the programs of the new states of the signals. With the preconditions of the working demands of the machine and the working conditions of the oil-wells, the efficiency of the oil extraction should reach its highest limitations.

If because of the change of the oil-well, the efficiency of the oil extraction changes, the electric circuits should start a second program. The parameters of the program of the new states of the signals will be regenerated to keep the machine working with the optimal efficiency for oil extraction. At the same time, the machine should keep working in a running condition that reaches the utmost limit of energy saving.

The function of the brake unit 18.1 and the brake resistance 18.2 is to apply the brake and consume the electric energy during the control of the electrical machine in reverse and for travel arresting.

The instructions for operating the machine are as follows:

1. The numerical value of the starting speed for operation
2. The numerical value of the breaking speed
3. The numerical value of the stroke distance for operation
4. The numerical value of the oil pumping strokes time for operation
5. The numerical value of the speed of the return trip for operation
6. The numerical value of the pump load for operation
7. The numerical value of the pump off control
8. The instructions of the protection program for pumping control
9. The instructions of alarm
10. The instructions for self protection

EXAMPLE

The instructions for the machines operation: The time for starting is one second. The revolution of the electrical machine steps up from 0 to 1380 in one second. The distance of the stroke is 6 m, and the time for oil extraction is 3 seconds. The time for breaking is one second. The revolution of the electrical machine reduces from 1380 to 0 in one second. The time, the distance and the speed of the return trip are the same as those of the up-stroke. The running result is that the time for the process of oil extraction once is 10 seconds, the stroke is 6 m, the oil pumping strokes is 6 times per minute, and the oil production is 3 kg for each time.

A second embodiment of the invention is shown in FIGS. 7 to 12 On the whole, the structure and the principle of operation are the same as those of example 1. The difference is that in this example the augmenter coder 15 and the oil flowmeter 19 are both left out. Since the augmenter coder 15 is omitted, the control system changes from a closed-loop control to an open loop control. The oil flowmeter is omitted, so there is no parameter of the oil measuring in the control system. This example of operation has the advantages of saving devices and reducing costs. The disadvantage is that the precision of the converter electrical machine operation decreases, so it doesn't adapt to the precise control of the revolution of the electrical machine in the oil-wells where the work conditions are very complex. There is a second disadvantage. It can not accurately calculate the oil production and it may influence the adjustment of the precise parameters of the starting speed, the return trip speed, the stroke and the oil pumping strokes.

What is claimed is:

1. A fully automatic machine for oil extraction, characterized in that, in this fully automatic machine for oil extraction, an axle transmission and soft belt suspension system are used; an axle connects an electric motor (17) and a decelerator (5); and an axle connects the decelerator (5) and a driving hub (7A), whereby the transmission belts (10A) and (10B) are driven; following the connection of a driven hub (7B) and a bridle (9), the sucker rod (8) will be connected so that an oil well pump (24) can be driven to work; when the electric motor (17) rotates in a forward direction, the oil will be extracted; when the electric motor (17) rotates in a reverse direction, it is a return trip; when the driving hub (7A) drives the transmission belts (10A) and (10B), it also drives a transmission belt (11); one end of the transmission belt (11) is connected to a balancer (12) that works synchronously as the oil well pump works in a forward or a reverse direction; said machine for oil extraction comprises a base (1), a bracket (2) and a platform (3); the electric motor (17), the decelerator (5), the driving hub (7A) and the driven hub (7B) are all fixed on the platform (3); the electric motor (17) and an oil production process controller (20) are connected by a masterdrive frequency transformer (18), the electromotor (17) receives the control instructions sent by the oil production process controller (20) through the masterdrive frequency transformer (18) that works as a host drive; the oil production process controller (20) connects an absolute value coder (16) that can render the running states, so that it can collect the information about the position and angle of rotation of the driving hub's output axle; the absolute value coder (16) and a break unit constitute a travel detecting and break part.

2. The fully automatic machine for oil extraction according to claim 1, characterized in that the oil production process controller (20) comprises a central processing unit, an input/output module and a liquid crystal display.

3. The fully automatic machine for oil extraction according to claim 1, characterized in that in this machine the oil production process controller (20) is connected with a augmenter coder (15) and an oil flowmeter (19) respectively, whereby it can collect the information about the rotational speed of the electric motor and the oil flow of the producing tube respectively; the augmenter coder (15) can directly get the information about the angle, position and rotational speed from the axle of the electric motor (17); after the programmed control of the oil production process controller, new control instructions are generated; the new control instructions can control the reversing of the electric motor (17) as well as set and adjust its rotational speed.

* * * * *